US006529213B1

(12) United States Patent
Kimura

(10) Patent No.: US 6,529,213 B1
(45) Date of Patent: Mar. 4, 2003

(54) DISPLAY DEVICE

(75) Inventor: Mutsumi Kimura, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/492,293

(22) Filed: Jan. 27, 2000

(30) Foreign Application Priority Data

Jan. 29, 1999 (JP) ..... 11-021624
Nov. 26, 1999 (JP) ..... 11-336265

(51) Int. Cl.[7] ..... G09G 5/02
(52) U.S. Cl. ..... 345/696; 345/695
(58) Field of Search ..... 345/589, 613, 345/690, 695, 696, 694, 76, 205

(56) References Cited

U.S. PATENT DOCUMENTS 5,126,865 A * 6/1992 Sarma ..... 345/103
5,808,594 A * 9/1998 Tsuboyama et al. ..... 345/89
5,986,632 A * 11/1999 Takayama et al. ..... 345/99

FOREIGN PATENT DOCUMENTS

EP 0 261 898 3/1988
EP 0 671 648 A2 9/1995
EP 0 671 649 A2 9/1995
EP 0 810 578 A1 12/1997
GB 2 217 088 A 10/1989
JP 11-73158 3/1999
WO WO99/01856 1/1999

OTHER PUBLICATIONS

Beck et al., "P–37: AMEL Power Considerations", SID 97 DIGEST, vol. 28, May 13, 1997, pp. 615–618.

* cited by examiner

*Primary Examiner*—Kent Chang
(74) *Attorney, Agent, or Firm*—Oliff & Berridge PLC

(57) ABSTRACT

Luminescent portions correspondent to each gradation are arranged point-symmetrically with one another around a prescribed position provided at the center, thereby forming a unit pixel element including a plurality of luminescent elements. Such a structure allows provision of a display device wherein a luminous center does not shift for each gradation. Accordingly, when the brightness of the displayed images is changed, unfavorable shifting of display positions does not take place. The present invention thus solves defects related to the picture quality, such as flickering of images, or an impression of unnatural display or fatigue caused to the viewer.

20 Claims, 6 Drawing Sheets

DISPLAY DEVICE

BACKGROUND OF THE INVENTION

1. Field of the Invention

The present invention generally relates to a display device, especially to an improved technology of gradation display.

2. Description of the Related Art

TFT-ELDs, namely thin-film-transistor (TFT) driven electoroluminescent displays, which include electoroluminescent elements (EL elements) driven and controlled by thin film transistors, are considered as future potential displays due to their light weight, small size, high resolution, wide visual field, low electric consumption, etc.

FIG. 4 is a circuit diagram of a conventional TFT-ELD, and FIG. 5 is a cross section of such TFT-ELD. FIG. 4 shows a unit pixel 11 of the TFT-ELD, a scanning line 12, a signal line 13, current supplying line 14, a retention capacitor 15, a selective transistor 16, a driving transistor 17, and an EL element 15. As shown in FIG. 5, the driving transistor 17 for adjusting light emission intensity (gradation) of the EL element 18 is formed on a glass substrate 10. A drain electrode of the driving transistor 17 is connected to a cathode (transparent electrode) 21 of the EL element 18, and a source electrode is connected to the analog signal supply line 14. The EL element 18 is formed of the anode 21, a luminescent layer 22, and an cathode 23. The EL element 18 may be a inorganic electroluminescent element, a low-molecular organic electroluminescent element, or a high-molecular organic electroluminescent element.

The selective transistor 16 includes a gate electrode connected to the scanning line 12, a source electrode connected to a signal line 13, and a drain electrode connected to a gate electrode of the driving transistor 17. The retention capacitor 15 is provided between the analog signal supplying line 14 and the source electrode of the selective transistor 16.

In order to cause the EL element 18 to emit light in the aforementioned structure, the scanning line 12 and the signal line 13 are set at level "H", and current is conducted between the drain and the source of the selective transistor 16, whereby the driving transistor 17 is on state. An analog signal supplied from the analog supplying line 14 in this condition is delivered to the retention capacitor 15 and alters the conductance of the driving transistor 17. As a result, the EL element 18 emits light with light emission intensity pursuant to the analog signal, thereby accomplishing gradations of light emission intensity.

However, as a problem of the above-described. structure, resolution of the picture lowers due to the EL element 18 included in each pixel emitting light with unequal light emission intensity, especially in the middle gradation, because of the difference in the transistor properties of the driving transistor 17.

In order to solve this problem, the applicant of the present invention suggested in Japanese Patent Laid-Open Publication No. HEI 11-73158 a technology of displaying respective gradations by controlling on/off states of light emission of EL elements and changing the luminous area for each gradation. FIG. 6 is a circuit diagram of the TFT-ELD disclosed in said Laid-Open Publication. FIG. 6 shows an EL element included in each pixel, which is formed of EL elements 18-1 and 18-2. Such structure allows display of four gradations by controlling on/off states of EL elements

18-1 and 18-2 respectively via a 2-bit signal line formed of signal lines 13-1 and 13-2. More specifically, there are: gradation "0", where neither EL element 18-1 nor 18-2 emits light; gradation "1", where only EL element 18-1 emits light; gradation "2", where only EL element 19-2 emits light; and gradation "3", where both EL elements 18-1 and 18-2 emit light. Luminous areas of EL element 18-1 and EL element 18-2 are in a ratio of 1:2.

As shown in FIG. 7, in the structure above, signals S, D1, and D2 are respectively supplied to the scanning line 12, signal line 13-1 and signal line 13-2. When signal S is set at level "H", current is conducted between the drain and the sources of selective transistors 16-1 and 16-2. In FIG. 7, gradation "1" is obtained when signal S is set at level "H", signal D1 at level RHO, and signal D2 at level "L". As a consequence, driving transistor 17-1 is turned on, and transistor 17-2 is turned off, whereby only EL element 18-1 emits light. Furthermore, in order to realize gradation "2", signal S should be set at level "H", signal D1 at level "L", and signal D2 at level "H". By doing so, driving transistor 17-2 is turned on and transistor 17-1 is turned off, and consequently, only EL element 18-2 emits light.

In this method, driving transistors 17-1 and 17-2 are to be regarded as either almost completely on state or almost completely off state. When driving transistors 17-1 and 17-2 are on state,resistance is negligibly small compared to the resistance of driving transistors 18-1 and 18-2, such that the amount of current conducted through driving transistors 17-1, 17-2, 18-1 and 18-2 depends substantially on the resistance of driving transistors 18-1 and 18-2 alone. Accordingly, light emission intensity is never uneven due to the difference in the transistor properties of driving transistors 18-1 and 18-2. Furthermore, when driving transistors 17-1 and 17-2 are off state, the voltage applied to EL elements 18-1 and 18-2 will be smaller than the threshold voltage, and driving transistors 18-1 and 19-2, will not emit light at all. Therefore, also in this case, the light emission intensity of EL elements 18-1 and 18-2 is never uneven by the difference in the transistor properties of driving transistors 18-1 and 18-2.

However, as a disadvantage of the aforementioned structure, the luminous center (the average position of the luminescent portion) shifts for each gradation and visibility is thereby decreased. Characteristics of such disadvantage will be explained with reference to FIGS. 8A–D. FIG. 8C, for example, shows a luminous center 40 of the unit pixel element 11. The EL element 18-1 shown with oblique lines means that no light is emitted, and the EL element 18-2 shown in white means that light is emitted. In FIG. 8A, the EL elements 18-1, 18-2 do not emit light. In FIG. 8B, only EL element 18-1 emits light. In FIG. 8C, only EL element 18-2 emits light. Finally, in FIG. 8D, both EL elements 18-1, 18-2 emit light. It is clear from these drawings that the position of the luminous center 40 changes for each gradation. As a consequence, when the brightness of a displayed image is changed, the position of the image shifts unfavorably. Furthermore, if the displayed image is actually observed here, the displayed image will be seen to flicker, causing an impression of unnatural display or fatigue to the viewer.

SUMMARY OF THE INVENTION

Accordingly, the object of the present invention is to overcome such disadvantage and to provide a display device wherein a luminous center does not shift for each light emission gradation.

In the present invention, in order to achieve said object, a unit pixel is formed of multiple EL elements whose luminescent portions corresponding to each gradation are arranged point-symmetrically with one another with respect to a prescribed point. Such structure allows provision of a display device wherein the position of a luminous center does not change for each gradation. "Prescribed position" here means, for example, a luminous center of the EL element upon realizing the gradation of minimum luminance.

Furthermore, each electroluminescent element is preferably configured to have a state of "emission" or "non-emission". By controlling on/off of the multiple Aluminescent elements, it is possible to prevent uneven aluminance caused by difference in the properties of luminescent elements. In order to achieve the structure above, electroluminescent elements may, for example, be used as luminescent elements, so that thin-film transistors may control the on/off states of light emission by the luminescent elements.

DESCRIPTION OF THE PREFERRED EMBODIMENTS (Embodiment 1)

Figure 1A:
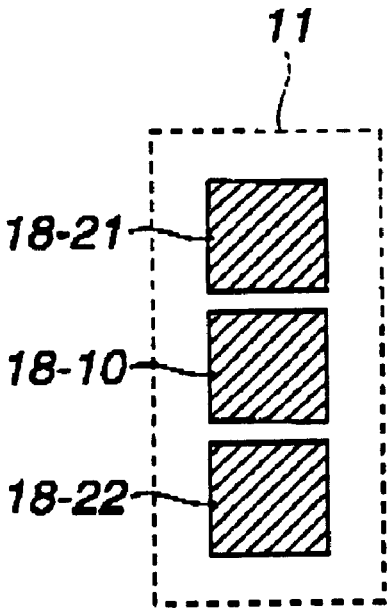
FIGS. 1A–D are explanatory diagrams showing the emission state of the respective EL elements forming a unit pixel in the TFT-ELD according to embodiment 1.

FIGS. 1A–D show a unit pixel 11 included in a display device according to the present invention. Each unit pixel has EL elements 18-10, 18-21 and 18-22, and is a 2 bit-4 gradation display. In FIG. 1A, for example, EL element 18-10 is an EL element for 0-bit display. The on/off states of EL elements 18-21 and 18-22 are simultaneously controlled by the same driving transistor, and EL element 18-21 is a first EL element for 1-bit display and EL element 18-22 is a second EL element for 1-bit display. Each EL element is driven and controlled by two scanning lines (for 0-bit and 1-bit display) which are not shown.

Furthermore, although FIGS. 1A–D show only the unit pixel element 11, in reality the unit pixel elements 11 are arranged in a matrix over the entire screen of the display device.

Figure 1B:
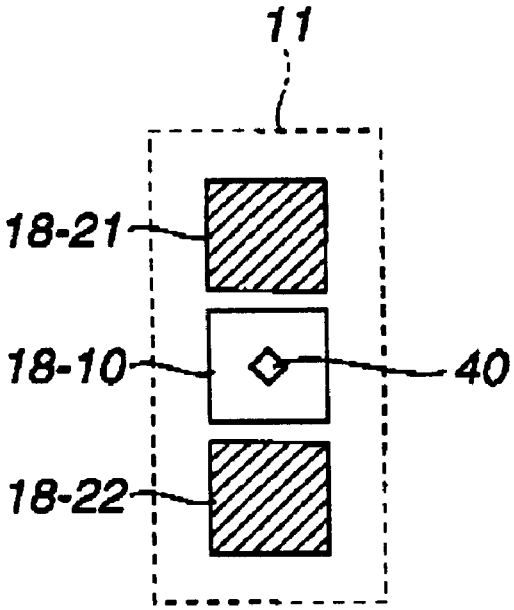
Figure 1C:
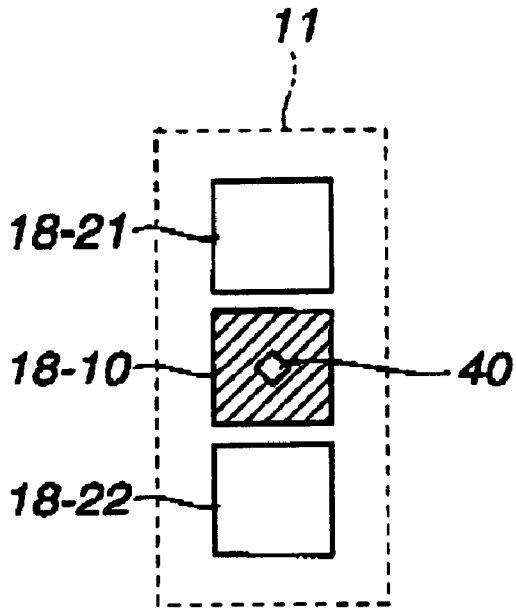
Figure 1D:
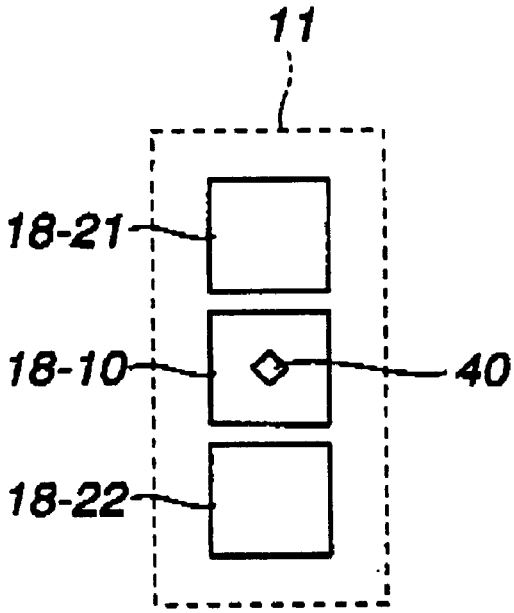

FIG. 1A shows emission by none of the EL elements (gradation "0"); FIG. 1B—emission only by EL element 18-10 (gradation "1"); FIG. 1C—emission only by EL elements 18-21 and 18-22 (gradation "2"); and FIG. 1D—emission by all EL elements 18-21, 18-10 and 18-22 (gradation "3").

As shown in FIGS. 1A–D, the luminous center 40 for each gradation is located at the same position as the luminous center of the luminescent portion (EL element 18-10), and configured such that it does not shift for each gradation. In other words, the luminescent portion corresponding to gradation "2" is located point-symmetrically with respect to the luminescent portion corresponding to gradation "1". Furthermore, the luminescent portion corresponding to gradation "3" is located point-symmetrically with respect to the luminescent portion corresponding to gradation "1". By arranging the luminescent portions point-symmetrically around a prescribed point provided at the center, easily obtained is a structure which prevents shifting of the luminous center 40. Accordingly, even when the brightness of a displayed image is changed, unfavorable shifting of the displayed position does not take place. Therefore, the present invention solves disadvantages related to the picture quality, such as flickering of images, or impression of unnatural display or fatigue caused to the viewer.

Furthermore, although respective EL elements are shaped in quadrilaterals (squares) in FIGS. 1A–D, they may be configured as circles or ovals. Moreover, by making the respective areas of EL elements 18-10, 18-21, and 18-22 uniform, light emission intensity for respective gradations may be increased or decreased linearly.

(Embodiment 2)

FIGS. 2A–D show a unit pixel 11 included in the display device. Each unit pixel is formed of EL elements 18-10, 18-21, 18-22, 18-31, 18-32, 18-33 and 18-34, and is a 3 bits-8 gradation display. In FIGS. 2A–D, EL element 18-10 is an EL element for 0-bit display. The on/off states of EL elements 18-21 and 18-22 are simultaneously controlled by the same driving transistor, and EL element 18-21 is a first EL element for 1-bit display and EL element 18-22 is a second EL element for 1-bit display. Similarly, the on/off states of EL elements 18-31, 18-32, 18-33 and 18-34 are simultaneously controlled by the same driving transistor. EL element 18-31 is a first EL element for 2-bit display, EL element 18-32 is a second EL element for 2-bit display, EL element 18-33 is a third EL element for 2-bit display, and EL element 18-34 is a fourth EL element for 2-bit display. Each EL element is driven and controlled by three scanning lines (for 0 to 2 bit display) which are not shown.

Furthermore, although FIGS. 2A–D only show the unit pixel element 11, in reality the unit pixel elements 11 are arranged in a matrix over the entire screen of the display device.

Figure 2A:
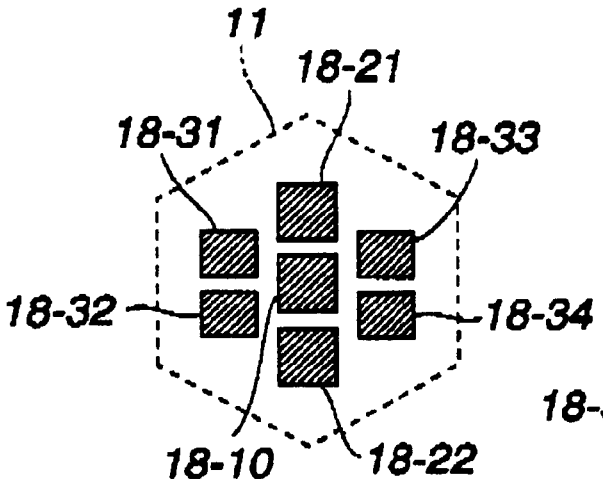
FIGS. 2A–D are explanatory diagrams showing a unit pixel in the TFT-ELD according to embodiment 2.
Figure 2B:
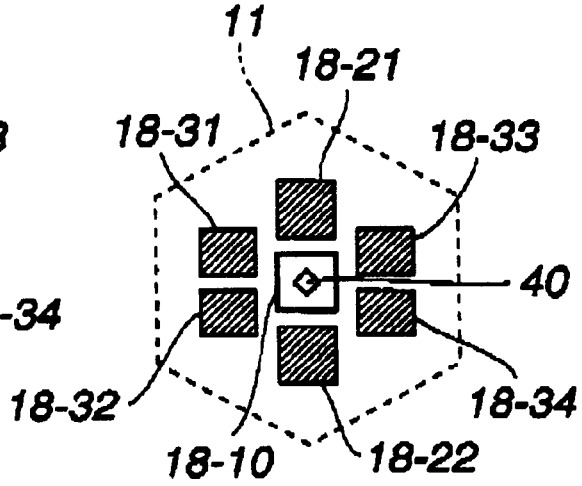
Figure 2C:
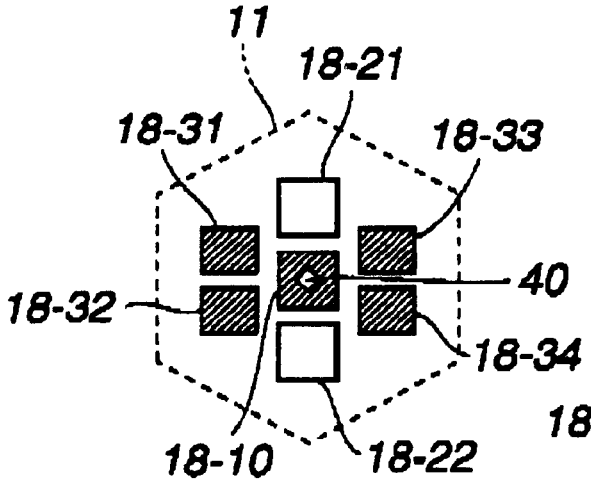
Figure 2D:
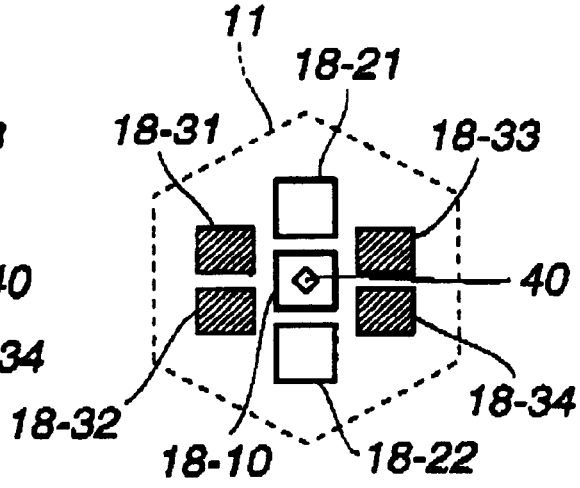
Figure 3A:
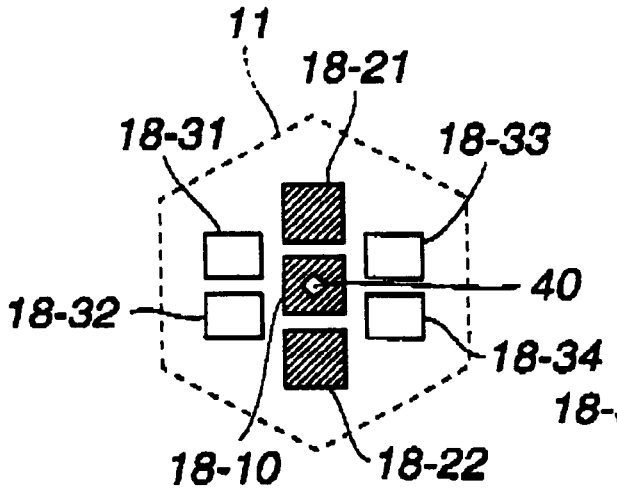
FIGS. 3A–D are explanatory diagrams showing the emission state of the respective EL elements forming a unit pixel in the TFT-ELD according to embodiment 2.
Figure 3B:
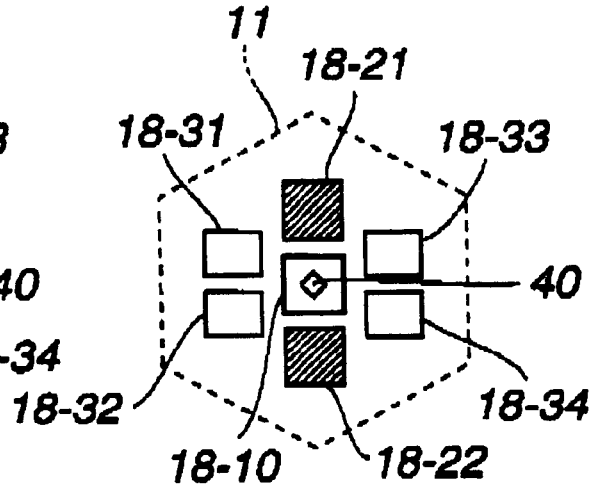
Figure 3C:
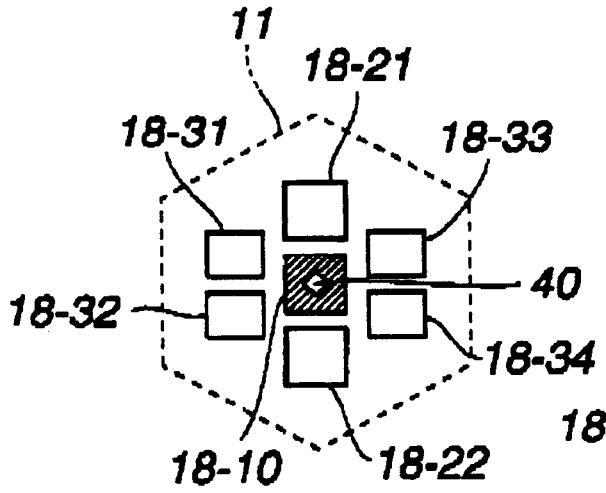
Figure 3D:
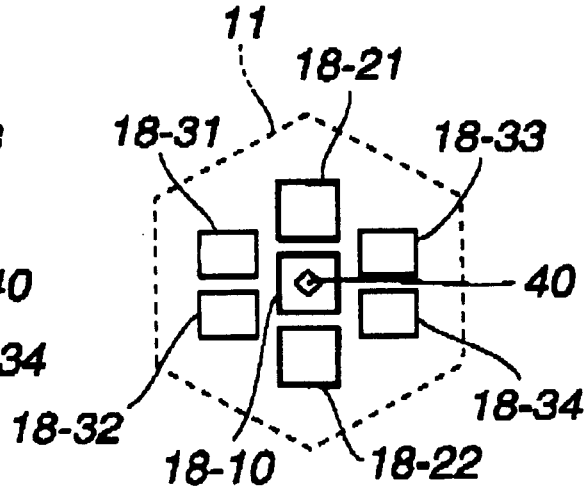
Figure 4:
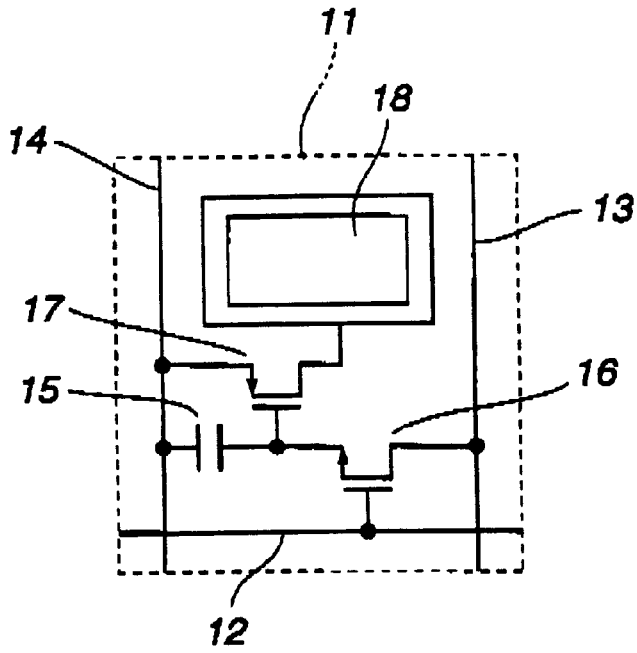
FIG. 4 is a circuit diagram of a unit pixel in a conventional TFT-ELD.
Figure 5:
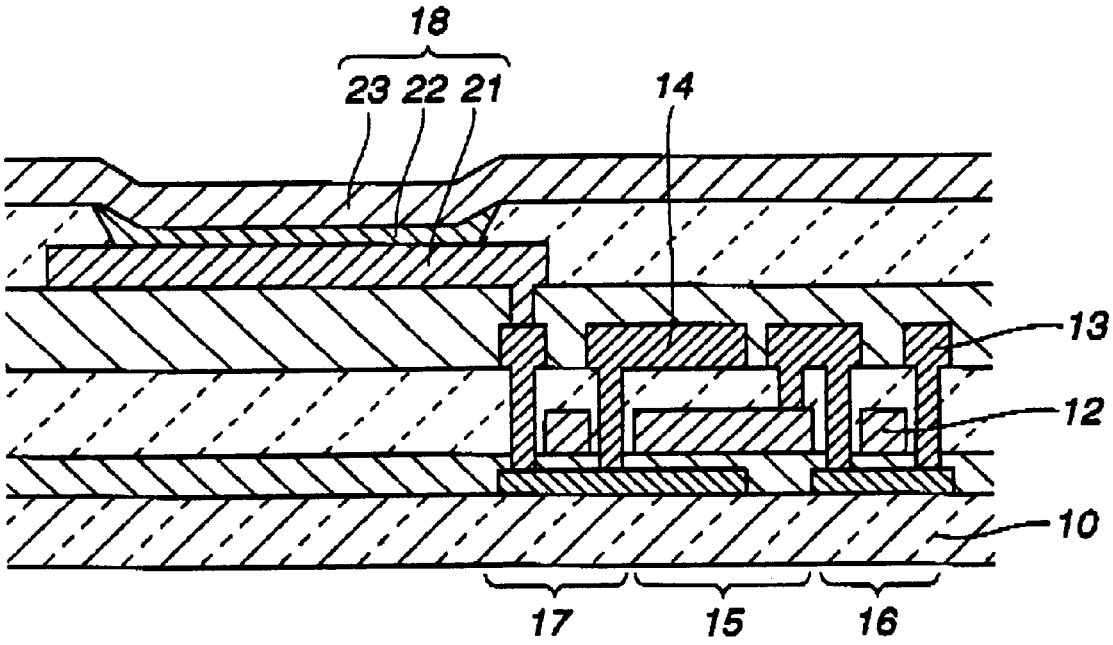
FIG. 5 is a cross section of a unit pixel in a conventional TFT-ELD.
Figure 6:
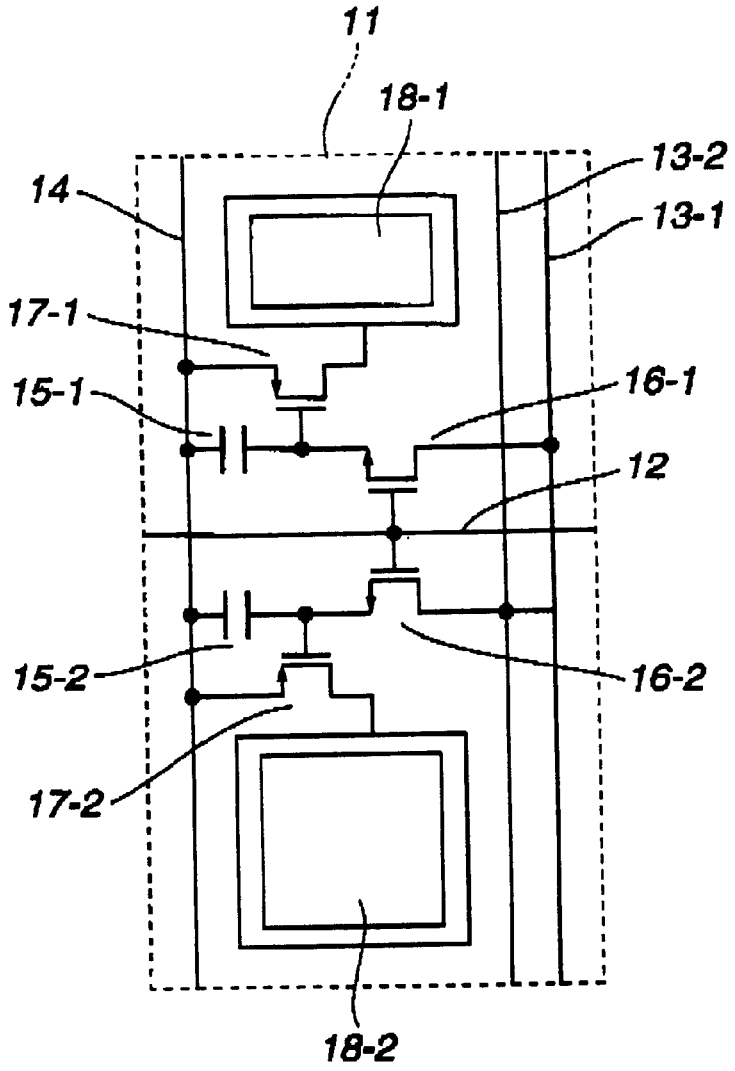
FIG. 6 is a circuit diagram of a unit pixel in a conventional TFT-ELD.
Figure 7:
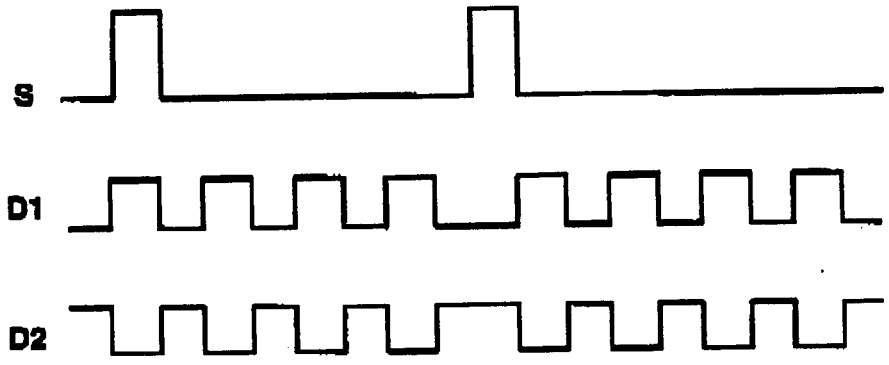
FIG. 7 is a timing chart indication a scanning line and a signal line of a conventional TFT-ELD.
Figure 8A:
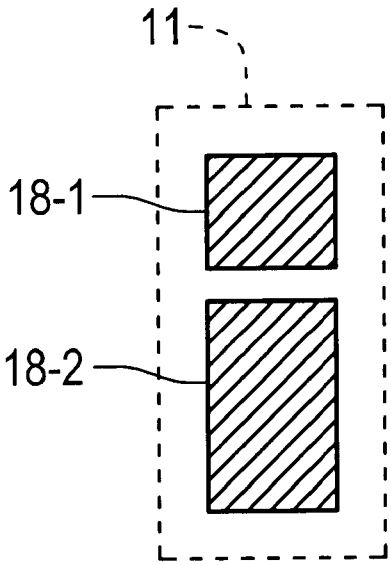
FIGS. 8A–D are explanatory diagrams showing the light emission state of the EL elements forming a unit pixel of a conventional TFT-ELD.
Figure 8B:
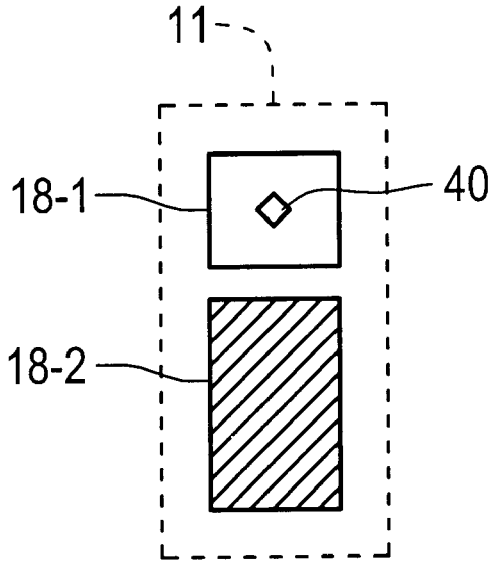
Figure 8C:
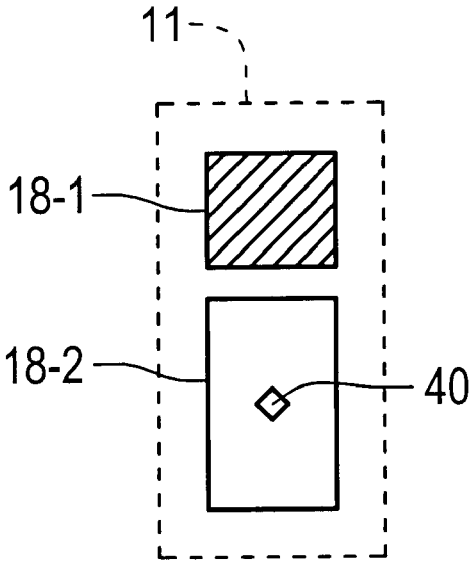
Figure 8D:
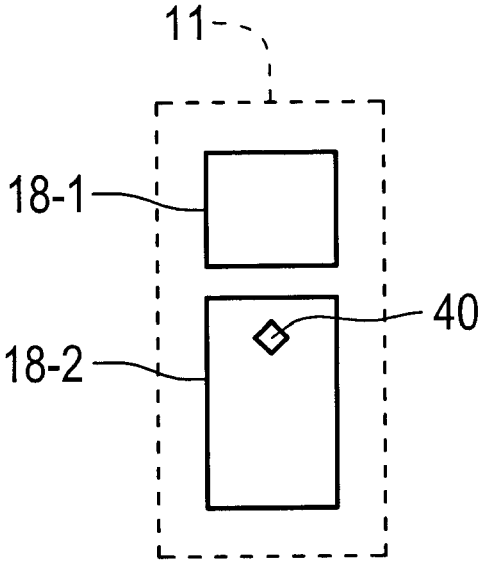

FIG. 2A shows that none of the EL elements emit light (gradation "0"); FIG. 2B—emission only by 0-bit display EL element 18-10 (gradation "1"); FIG. 2C—emission by only 1-bit display EL elements 18-21 and 18-22 (gradation "2"); and FIG. 2D, emission by 0-bit and 1-bit display EL elements 18-10, 18-21 and 18-22 (gradation "3"). Furthermore, FIG. 3A shows emission of only 2-bit display EL elements 18-31, 18-32, 18-33 and 18-34 (gradation "4"); FIG. 3B—emission of only 0-bit and 2-bit display EL elements 18-10, 18-31, 18-32, 18-33 and 18-34 (gradation "5"); FIG. 3C—emission of only 1-bit and 2-bit display EL elements 18-21, 18-22, 18-31, 18-32, 18-33 and 18-34 (gradation "6"); and FIG. 3D emission of all 0-bit, 1-bit and 2-bit display EL elements 18-10, 18-21, 18-22, 18-31, 18-32, 18-33 and 18-34 (gradation "7").

As shown in FIGS. 2A–D and 3A–D, the luminous center 40 for each gradation is located at the same position as the center point of the luminescent portion (EL element 18-10), and structured so as to avoid shifting for each gradation. In other words, the luminescent portion corresponding to gradation "2" is located point-symmetrically with respect to the luminescent portion corresponding to gradation "1". The luminescent portion corresponding to gradation "3" is located point-symmetrically with respect to the luminescent portion corresponding to gradation "1", and the luminescent portion corresponding to gradation "7" is located point-symmetrically with respect to the luminescent portion corresponding to gradation "1". By arranging luminescent portions point-symmetrically around a prescribed point provided at the center, easily obtained is a configuration which prevents shifting of the luminous center 40. Accordingly, even when the brightness of a displayed image is changed, unfavorable shifting of the display position does not take place. Therefore, the present invention solves disadvantages related to the picture quality, such as flickering of images, or impression of unnatural display or fatigue caused to the viewer.

Furthermore, although respective EL elements are shaped in quadrilaterals (squares) in FIGS. 2A–D, they may be configured as circles or ovals. Moreover, by making the respective areas of EL elements 18-10, 18-21, and 18-22, for example, uniform, light emission intensity for respective gradations may be increased or decreased linearly.

Furthermore, although the present embodiment is explained with eight gradations, different gradations may be obtained by adjusting the number of EL elements. The display device according to the present invention may be used for video cameras, digital cameras, car stereos, video CD players, portable terminals, laptop personal computers, etc.

What is claimed is:

1. A display device comprising:

a first luminescent element and a first driving transistor for controlling the first luminescent element;

a pair of second luminescent elements, the first luminescent element being positioned therebetween; and a second driving transistor controlling at least both of the second luminescent elements.

2. The display device according to claim 1, further comprising a first scanning line that controls at least both of the second luminescent elements.

3. The display device according to claim 2, further comprising a second scanning line that controls the first luminescent element.

4. The display device according to claim 1, each of the pair of the second luminescent elements including a plurality of luminescent elements.

5. The display device according to claim 1, further comprising a pair of third luminescent elements, the first luminescent element positioned therebetween.

6. The display device according to claim 5, further comprising a third driving transistor controlling at least both of the third luminescent elements.

7. The display device according to claim 6, wherein the pair of the second luminescent elements are in symmetrical position with respect to the first luminescent element.

8. The display device according to claim 1, further comprising a plurality of pixel units, each of the pixel units including the first and second luminescent elements.

9. A display device comprising:

a first luminescent element and a first scanning line that controls the first luminescent element;

a pair of second luminescent elements and a second common scanning line that controls the second pair of luminescent elements; and a pair of third luminescent elements and a third common scanning line that controls the third pair of luminescent elements, the first luminescent element being positioned between the pair of second luminescent element and between the pair of the third luminescent elements each of the pair of the second luminescent elements and the pair of the third luminescent elements being controlled by a common scanning line, respectively.

10. The display device according to claim 9, further comprising a driving transistor, at least one of the pair of the second luminescent elements and the pair of the third luminescent elements being controlled by the driven transistor.

11. The display device according to claim 9, wherein the pair of the second luminescent elements are in symmetrical position with respect to the first luminescent element.

12. The display device according to claim 11, wherein the pair of the third luminescent elements are in symmetrical position with respect to the first luminescent element.

13. The display device according to claim 9, further comprising a plurality of pixel units, each of the pixel units including the first, the second and the third luminescent elements.

14. A display device comprising:

a first luminescent element and a first scanning line that controls the first luminescent element;

a pair of second luminescent elements, the first luminescent element being positioned therebetween; and a second common scanning line controlling the pair of second luminescent elements.

15. The display device according to claim 14, further comprising a driving transistor controlling at least the pair of the second luminescent elements.

16. The display device according to claim 14, each of the pair of the second luminescent elements including a plurality of luminescent elements.

17. The display device according to claim 14, further comprising a pair of third luminescent elements, the first luminescent element positioned therebetween.

18. The display device according to claim 17, further comprising a third driving transistor controlling at least both of the third luminescent elements.

19. The display device according to claim 15, wherein the pair of the second luminescent elements are in symmetrical position with respect to the first luminescent element.

20. The display device according to claim 15, further comprising a plurality of pixel units, each of the pixel units including the first and second luminescent elements.

* * * * *